United States Patent [19]

Bateman

[11] Patent Number: 4,750,694

[45] Date of Patent: Jun. 14, 1988

[54] ADJUSTABLE DISPENSER FOR BAGS

[75] Inventor: Robert Bateman, Morristown, Tenn.

[73] Assignee: Lin Pac Corrugated, Inc., Atlanta, Ga.

[21] Appl. No.: 854,089

[22] Filed: Jun. 12, 1986

[51] Int. Cl.[4] ..... A63B 55/04

[52] U.S. Cl. ..... 248/97; 248/99; 248/175

[58] Field of Search ..... 248/97, 95, 99, 100, 248/101, 153, 175; 211/50, 49.1; 141/391

[56] References Cited

U.S. PATENT DOCUMENTS

| | | | |
|---|---|---|---|
| D. 264,650 | 6/1982 | Adamson . | |
| D. 264,651 | 6/1982 | Adamson . | |
| D. 264,653 | 6/1982 | Adamson . | |
| D. 264,905 | 6/1982 | Adamson . | |
| D. 273,159 | 3/1984 | Adamson et al. . | |
| 3,823,630 | 7/1974 | Suominen et al. | 83/98 |
| 3,858,382 | 1/1975 | Suominen | 53/385 |
| 4,106,734 | 8/1978 | Walitalo | 248/100 |
| 4,199,122 | 4/1980 | Christie | 248/97 |
| 4,241,561 | 12/1980 | Suominen | 53/384 X |
| 4,304,378 | 12/1981 | Briggs | 248/97 |
| 4,305,558 | 12/1981 | Baker . | |
| 4,316,353 | 2/1982 | Suominen . | |
| 4,332,361 | 6/1982 | McClellan | 248/99 X |
| 4,363,405 | 12/1982 | Christie . | |
| 4,372,512 | 2/1983 | Wolfe | 248/97 |
| 4,378,924 | 4/1983 | Christensen | 248/101 |
| 4,398,689 | 8/1983 | Prader | 248/99 |
| 4,458,867 | 7/1984 | Malik | 248/97 |
| 4,487,388 | 12/1984 | Provan | 248/97 |
| 4,498,652 | 2/1985 | Malik . | |

*Primary Examiner*—Ramon O. Ramirez
*Attorney, Agent, or Firm*—Kilpatrick & Cody

[57] ABSTRACT

Dispensers for storing flexible bags and holding such bags open at an appropriate height while they are being filled with items. The dispensers include a bag container or holder means such as a spool or hook which may be adjustably mounted vertically and laterally to the dispenser frame. A suspending means corresponding to the bag container means holds the handle of the bag not held by the container means and may accommodate an extender to allow the bag handle to be held adjustably in height. Such a dispenser may also be formed to be adjustable in width to accommodate larger bags and spread them appropriately for optimal wall separation. Novel C-shaped brackets may be used to receive wire rungs on the dispenser frame to allow the dispenser to be manually removed and remounted with a single swift motion at various heights to a counter, wall or other surface. The adjustability of the dispenser allows the handles of the bags to be supported at an appropriate height above the level at which the bag bottom is supported, in order to allow the user quickly and efficiently to place items in the bag without causing the bag walls to come together. As a result, the user can fill a bag in a manner that protects delicate goods such as fruits and yet it allows maximum utilization of space in the bag.

12 Claims, 5 Drawing Sheets

ADJUSTABLE DISPENSER FOR BAGS

This invention relates to dispensers for flexible bags such as bags used to carry merchandise purchased in grocery stores or hardware stores. The dispensers are configured to be adjustable in order to accommodate many sizes and shapes of bags, to allow such bags to be stored neatly and compactly and to let the user spread and fill the bags quickly and efficiently.

BACKGROUND OF THE INVENTION

Grocery stores, hardware stores and other merchants recently began using flexible plastic bags as containers for customers' purchases. The transition from paper bags to plastic bags can be attributed to many reasons, including economies of cost and storage and transportation space, and the facts that plastic bags have handles and do not rip or tear as easily as paper bags. Whatever the causes for this change, plastic bags differ from paper bags in one major respect: They cannot support themselves while being filled with merchandise. Accordingly, plastic bags require merchants to utilize bag dispensers to store such bags and to hold them open in a convenient manner while being filled with merchandise.

The number of manufacturers of plastic bags and the varieties of types and sizes of plastic bags produced increases with the increasing popularity of the bags. As a result, retailers are frequently tempted to change bag suppliers and therefore typically the sizes of bags they buy. A given bag dispenser, however, optimally accommodates only a narrow range of bag sizes. A dispenser that is too tall for a bag causes the walls of the bag to come together as the bag is being filled. It is thus more difficult to arrange items in the bag in a manner that protects delicate goods such as fruit from being crushed while maximizing use of space in the bag. A similar problem results when a bag is spread too widely or narrowly. On the other hand, if the dispenser is too short, it is difficult to load the bag to full capacity.

Shopping bag dispensers formed of wire are conventional, as shown, for instance, in U.S. Pat. No. 4,199,122 issued Apr. 22, 1980 to Christie. That patent discloses a three-sided support rack. The sides support the walls of the shopping bag being filled and have at their upper extremities suspending means about which the bag handles may be placed. Such a structure fails, however, to assist in keeping the walls of a shopping bag separated while the bag is being filled.

One technique of maintaining flexible bag walls separated from one another while the bag is being filled is shown in U.S. Pat. No. 4,332,361 issued June 1, 1982 to McClellan. That patent also discloses a wire formed rack. Top portions of each side of the rack, however, are fitted with rotatable members which may be swung down into the interior of a bag after its handles have been placed about the suspending means. Although the McClellan invention is aimed primarily at providing a system for reusing plastic bags at home for garbage collection or similar purposes, it seems to provide one answer to keeping shopping bag walls separated in a grocery store or similar environment where bags must be quickly and efficiently filled with merchandise. However, the McClellan system requires additional efforts by the person filling the bag to position the rotatable members and thus reduces speed and efficiency which are highly desirable in store applications.

SUMMARY OF THE INVENTION

The present invention provides bag dispensers which may be adjusted to a variety of configurations in order to accommodate various sizes and shapes of flexible bags. As a result, the person filling a bag in such a dispenser is not required to rotate members into the bag or otherwise physically force the walls of the bag apart in order to maintain separation of the walls as the bag is being filled. Such dispensers therefore enjoy the advantage of allowing the user quickly and efficiently to place items side by side in the bag without moving parts of the dispenser or using one hand to separate the bag walls and one hand to move items into the bag. The user thus can have both hands free to lift items from the counter and to place the items in the bag without worrying that the bag walls will come together as the first one or two items are placed in the bag or that he or she will not be able to fill the bag to its limit.

Dispensers according to the present invention include a bag container or holder such as a spool or hook which may be adjustably mounted vertically and laterally to the frame of the dispenser. A retainer may be utilized to hold the bags being stored in place and to separate them from the bag which is spread open for use. A suspending means corresponding to the bag container holds the handle of the bag not held by the container and may accommodate an extender to allow the bag handle to be held adjustably in height. The dispenser may be adjustable in width to accommodate larger bags and spread them appropriately for optimal wall separation. Additionally, novel C-shaped brackets may be utilized in conjunction with wire rungs on the dispenser frame to allow the dispenser to be manually removed and remounted with a single swift motion at various heights on a counter, wall or other surface.

It is therefore an object of the present invention to provide a dispenser for flexible bags which adjustably accommodates various sizes and shapes of such bags and adjustably accommodates the surface to which it is mounted.

It is an additional object of the present invention to provide a dispenser for flexible bags which maintains appropriate wall separation while a bag is filled in order to minimize the attention the operator must pay to wall separation while filling the bag.

It is an additional object of the present invention to provide a dispenser for flexible bags which stores bags in a convenient and easily accessible manner and which allows a bag to be spread open for use at a height which allows its bottom to be supported in a fashion that maintains optimal bag shape as the bag is being filled.

It is an additional object of the present invention to provide a dispenser for flexible bags in which the portions which spread a bag for use may be adjusted at various distances from one another in order to accommodate bags of various heights and widths in a fashion that maintains optimal bag shape while the bag is being filled.

It is an additional object of the present invention to provide a dispenser for flexible bags in which the entire dispenser may be quickly and easily removed and adjustably remounted to its supporting surface in order to allow the dispenser to accommodate bags of varying heights and widths and to support the bottom of the bags in such a fashion as to maintain optimal bag shape as they are being filled.

It is an additional object of the present invention to provide a dispenser for flexible bags which is inexpensive, portable and economical and efficient to use.

Other objects, features and advantages of the present invention will become apparent with reference to the remainder of the specification, including the claims, and the drawings.

DETAILED DESCRIPTION OF THE DRAWINGS

Figure 1:
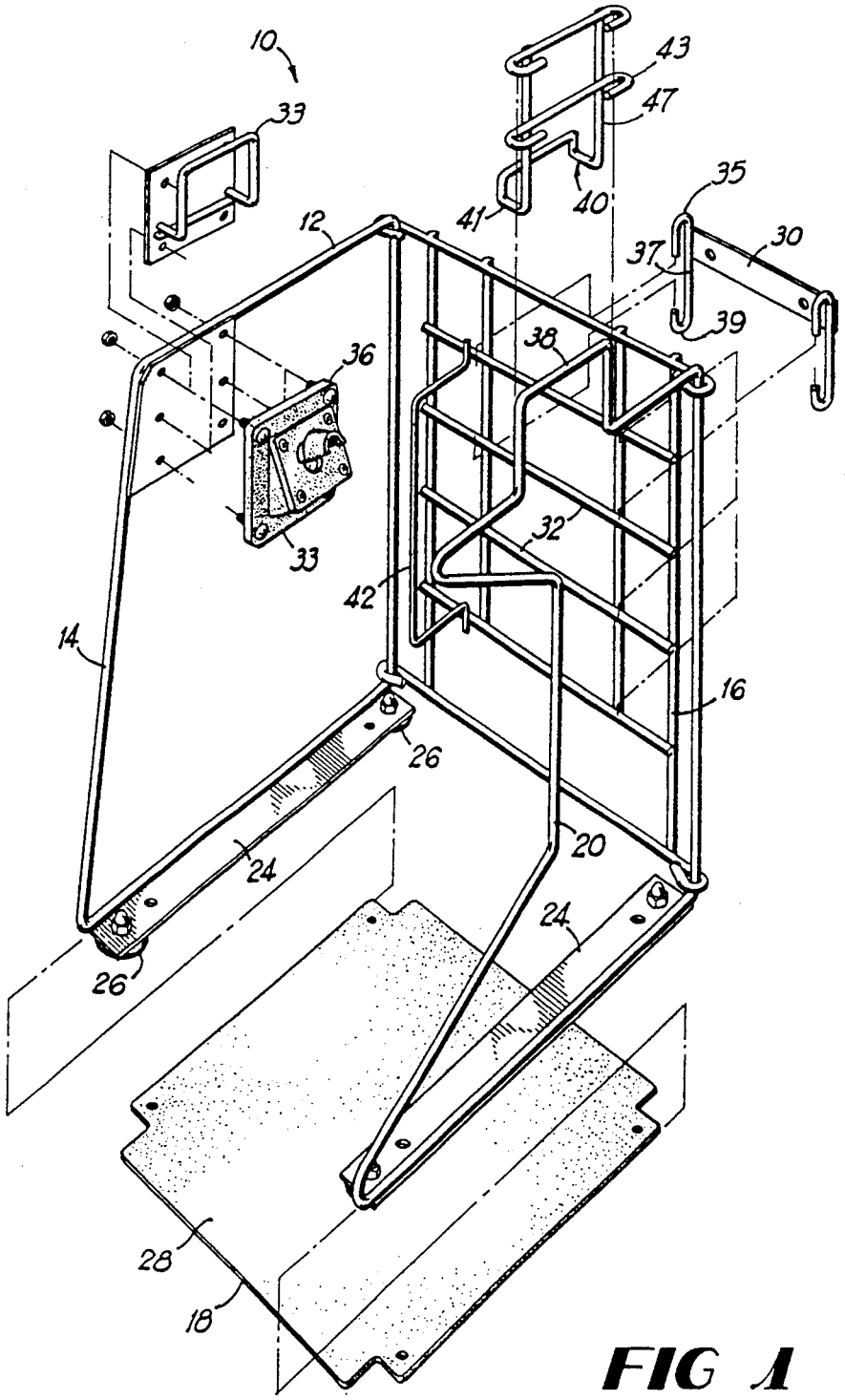
FIG. 1 is an exploded perspective view of a first embodiment of a dispenser according to the present invention.
Figure 2:
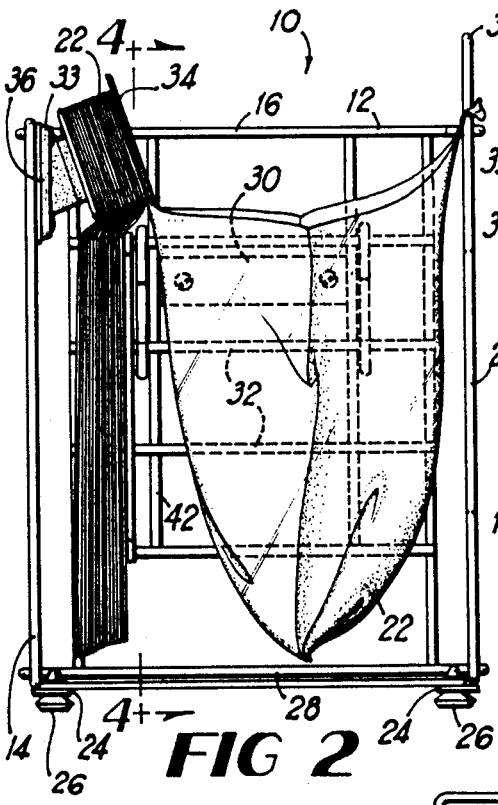
FIG. 2 is a front elevational view of the dispenser of FIG. 1 showing a bag spread for use.
Figure 3:
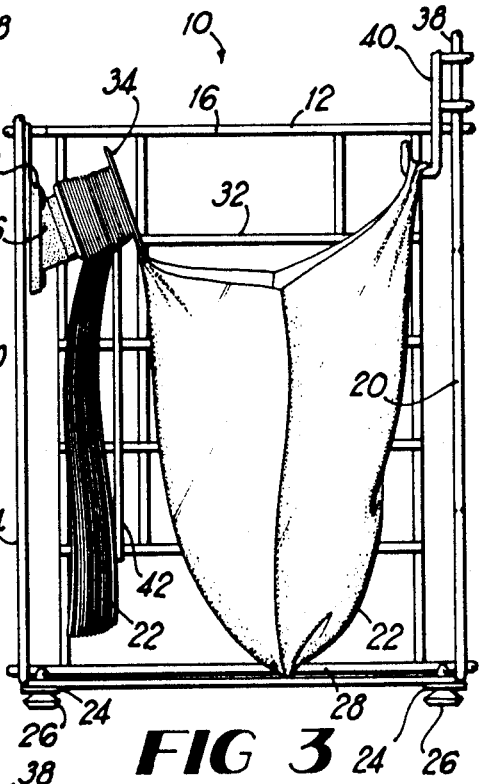
FIG. 3 is a front elevational view of the dispenser of FIG. 1 showing adjustments made to accommodate a smaller bag than does the dispenser shown in FIG. 2.
Figure 4:
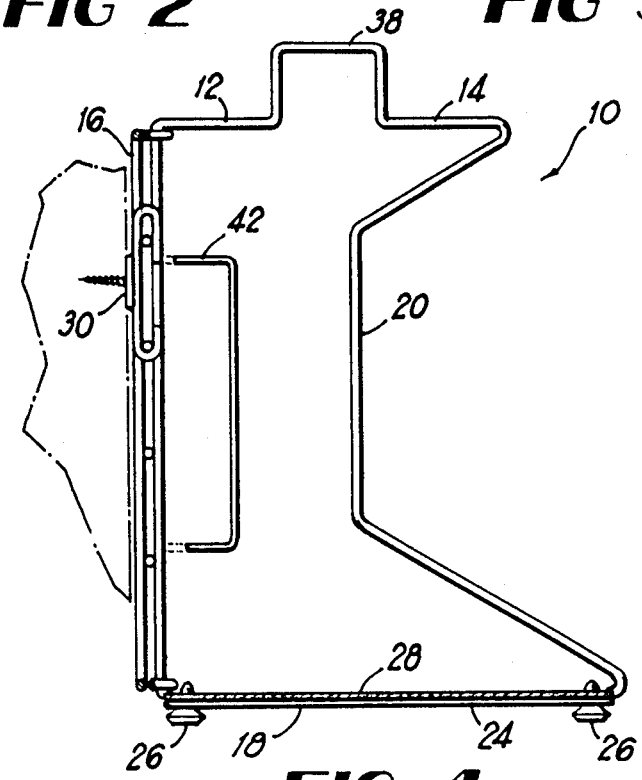
FIG. 4 is a cross-sectional view of the dispenser of FIG. 2 through section 4—4 of FIG. 2.

FIG. 1 is a perspective view of a first embodiment of a bag dispenser 10 according to the present invention. Dispenser 10 may be configured to accommodate a large variety of plastic or other flexible bags. It may be used by commercial establishments such as retailers for bagging merchandise, at home for purposes such as garbage disposal or compost storage, or in other suitable applications requiring that a flexible bag be supported and held open in order to receive or hold objects.

Dispenser 10 may take many forms in order to achieve its primary objective of accommodating many sizes and varieties of flexible bags. In the first embodiment shown in FIG. 1, for instance, dispenser 10 comprises a frame 12 which has two side portions 14 connected to a back portion 16. Frame 12 of dispenser 10 of FIG. 1 is formed of bent wire. Sheet metal, wood or other suitable materials may also be used. Side portions 14 may be rotatably connected to back portion 16 as they are in dispenser 10 of FIG. 1 in order to enhance the portability of dispenser 10 and save transportation and storage costs. One or both side portions 14 may include an indented portion 20 to allow the user to reach into dispenser 10 more easily and spread or otherwise access bags 22. Side portions 14 of dispenser 10 of FIG. 1 also may include flanges 24 attached horizontally on their bottom portions to receive feet 26. Flanges 24 may be sheet metal welded to side portions 14, bends formed inside portion 14 or other similar means. Flanges 24 are useful for attaching feet 26, which may be conventional bolt-on rubber or other type feet or pads for reducing the tendency of dispenser 10 to slide.

A baseboard 28 may be added to dispenser 10 of FIG. 1 for supporting bags 22. Baseboard 28 may be of plastic, wood or other desirable material. As shown in FIG. 1, it may contain notches at its corners for cooperating with side portions 14 and back portion 16 for being held in place. Alternatively, baseboard 28 may be bolted or otherwise attached to side portions 14, back portion 16 or flanges 24.

Back portion 16 of frame 12 of dispenser 10 is preferably constructed to receive adjustably one or more mounting bails or brackets 30. Bracket 30 may be used to hang dispenser 10 from a vertical surface such as that found at the end of a check-out counter in a grocery store. Bracket 30 may be adjustably connected to back portion 16 or, if desired, to side portions 14 by hooking it around two or more rungs 32 as shown in FIG. 1. The bracket 30 of FIG. 1 has two C-shaped members 37 whose upper hook portions 35 are longer than the lower hook portions 39. An upper rung of frame 12 is inserted into the upper hook portions 35 of bracket 30 and forced to the upper limit of the hooks. Frame 12 is rotated to force a lower rung 32 into the lower hook portions 39 of bracket 30. Then, frame 12 is lowered and the longer upper hook portions 35 of bracket 30 capture the upper rung while the lower hook portions 39 capture the lower rung. Alternatively, bracket 30 may be a set of hooks which simply fit into holes formed in back portion 16 or a side portion 14, or other appropriate fastener which is adjustably attached to either of those portions and which may be mounted on a vertical surface. The adjustable nature of the connection between bracket 30 and frame 12 allows dispenser 10 to be removed easily when desired or adjusted to a convenient height for a particular person using the dispenser to reduce back strain and improve efficiency. If dispenser 10 does not include flanges 24 and baseboard 28, the adjustable nature of this connection also allows dispenser 10 to be adjusted in height so that bottoms of bags 22 are supported by the surface underneath dispenser 10 to maintain a bag 22 in optimal shape while it is being filled.

Bags 22 may be stored in or near dispenser 10 in a number of ways. For instance, they may be stacked under or near dispenser 10. They also may be stored in the dispenser on a container or holder means 33. In the embodiment shown in FIGS. 1–4, holder means 33 comprises a spool 34. Spool 34 snaps onto receiver 36 which is in turn adjustably bolted, snapped or otherwise fastened to a side portion 14. Receiver 36 may be adjustably fastened laterally, as well as vertically, to frame 12. Spool 34 and receiver 36 may be constructed according to the disclosures in U.S. Pat. No. 3,823,630 issued July 16, 1974 to Suominen et al, U.S. Pat. No. 3,858,382 issued Jan. 7, 1975 to Suominen, or U.S. Pat. No. 4,241,561 issued Dec. 30, 1980 to Suominen, which patents are incorporated herein by reference, or by other similar or alternative means. Conveniently, bags 22 may be shipped on spool 34 which can be simply snapped into place on receiver 36 for storage and use in dispenser 10. Holder means 33 may also be a simple loop of wire 33′ or other desired structure, as shown in FIG. 1.

Use of a spool 34 with stored bags 22 allows the user to spread and begin filling a bag 22 with one hand. The user simply pulls one handle of the bag 22 off the spool 34 and drapes it over suspending loop or member 38 located on the top of the opposite side portion 14. In the embodiment shown in FIG. 1, suspending member 38 is simply a series of bends in the wire forming side portion 14 which establishes a hook or protuberance extending upward to capture a handle of a bag 22.

The suspending member 38 of dispenser 10 shown in FIGS. 1–4 is configured to receive an extender 40. Extender 40 comprises a loop of wire 41 which is J-shaped in cross-section and which has C-shaped hooks 43 on shafts 47 of the J to capture portions of suspending member 38. Extender 40 may thus be slipped over and captured by suspending member 38 to provide a hook for bag handles that is lower or higher than suspending member 38 depending on the configuration of extender 40.

Dispenser 10 may thus be adjusted for bag height, among other ways, by fastening receiver 36 to side portion 14 at a desired height and by using various sizes of extenders 40 or not using extenders 40.

A retainer may be utilized to hold in place bags 22 which are being stored on spool 34. Retainer 42 in the embodiment shown in FIGS. 1–4 is a vertically oriented generally U-shaped loop of wire welded to back portion 16. It similarly may be a sheet of metal or wood or of other desirable material and configuration, and it may be rotatably mounted to back portion 16 to permit it to be rotated out of the way against back portion 16 when not needed.

Figure 5:
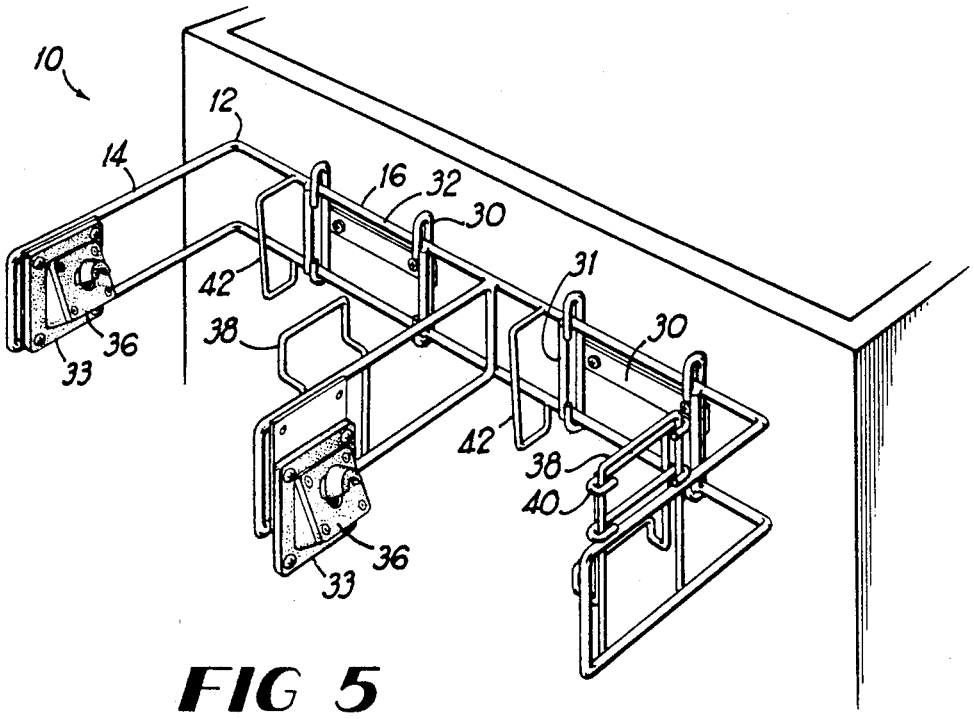
FIG. 5 is an exploded perspective view of a second embodiment of a dispenser according to the present invention.
Figure 6:
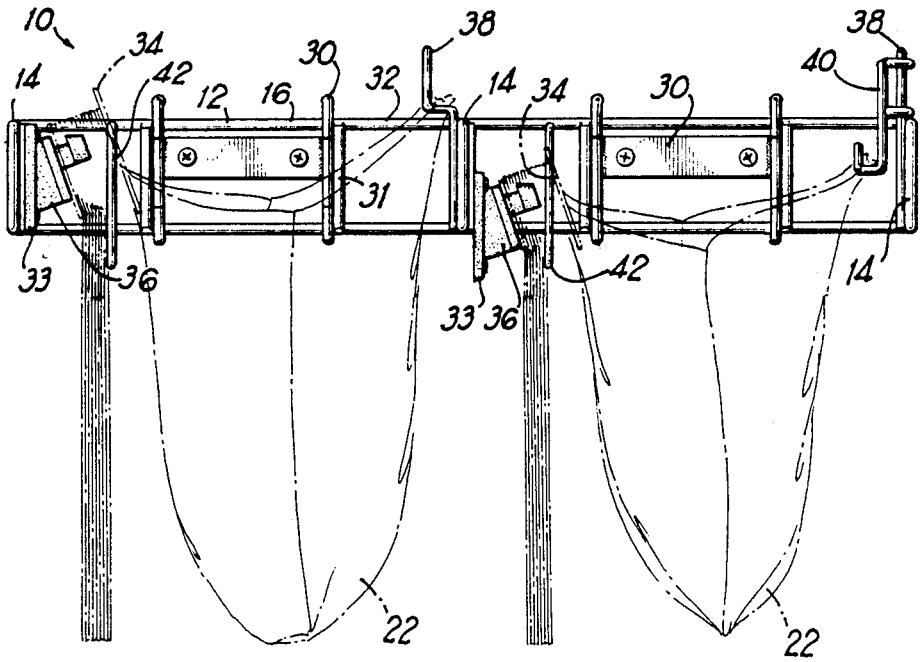
FIG. 6 is a front elevational view of the dispenser of FIG. 5 in which the left portion of the dispenser is adjusted to accommodate larger bags while the right portion is adjusted to accommodate smaller bags.

FIGS. 5 and 6 illustrate a second embodiment of a dispenser 10' according to the present invention configured to be adjustable to accommodate various sizes of flexible bags. Frame 12 is generally shaped in the form of the letter "W". Each cell of the W is adapted to dispense bags 22. A dispenser 10' according to this embodiment is particularly convenient for installation on vertical walls at the end of counters, or for locations where two sizes of bags 22 are desired to be available for use.

Similar dispensers 10' may be formed having three or more cells, depending upon the varieties of sizes and types of bags which are desired to be available for use.

Frame 12 of the embodiment of FIGS. 5 and 6 may be mounted to a vertical wall using brackets 30 similar to those in the embodiments shown in FIGS. 1–4. Such brackets 30 allow for easy removal and reinstallation. Sliding of frame 12 relative to brackets 30 may be inhibited by placing abutments 31 on frame 12 in the area where it receives brackets 30. Abutments 31 may simply be portions of wire or other protuberances extending from frame 12, or other similar desired means.

The bag suspending and storage means, comprising holding means 33, suspending means 38 and extender 40 of FIGS. 5 and 6 cooperate with the horizontal surface underlying dispenser 10' to maintain bags 22 in optimal shape while being filled. For instance, the receiver 36 and spool 34, together with the corresponding suspending member 38 of the left cell of dispenser 10' of FIGS. 5 and 6 are adjusted to accommodate taller bags or bags whose handles are located further from their bottom portions. The spool 34 and receiver 36 of the right cell, on the other hand, are hand mounted in a position lower than that of the spool 34 and 36 of the left cell. Similarly, an extender 40 is placed over spreading member 38. This configuration accommodates shorter bags or bags with handles located closer to their bottoms than the handles of bags 22 used in the left cell of dispenser 10 of FIGS. 5 and 6.

Retainers 42 may be used in a manner similar to that in which they are used in connection with the dispenser of FIGS. 1–4.

Figure 7:
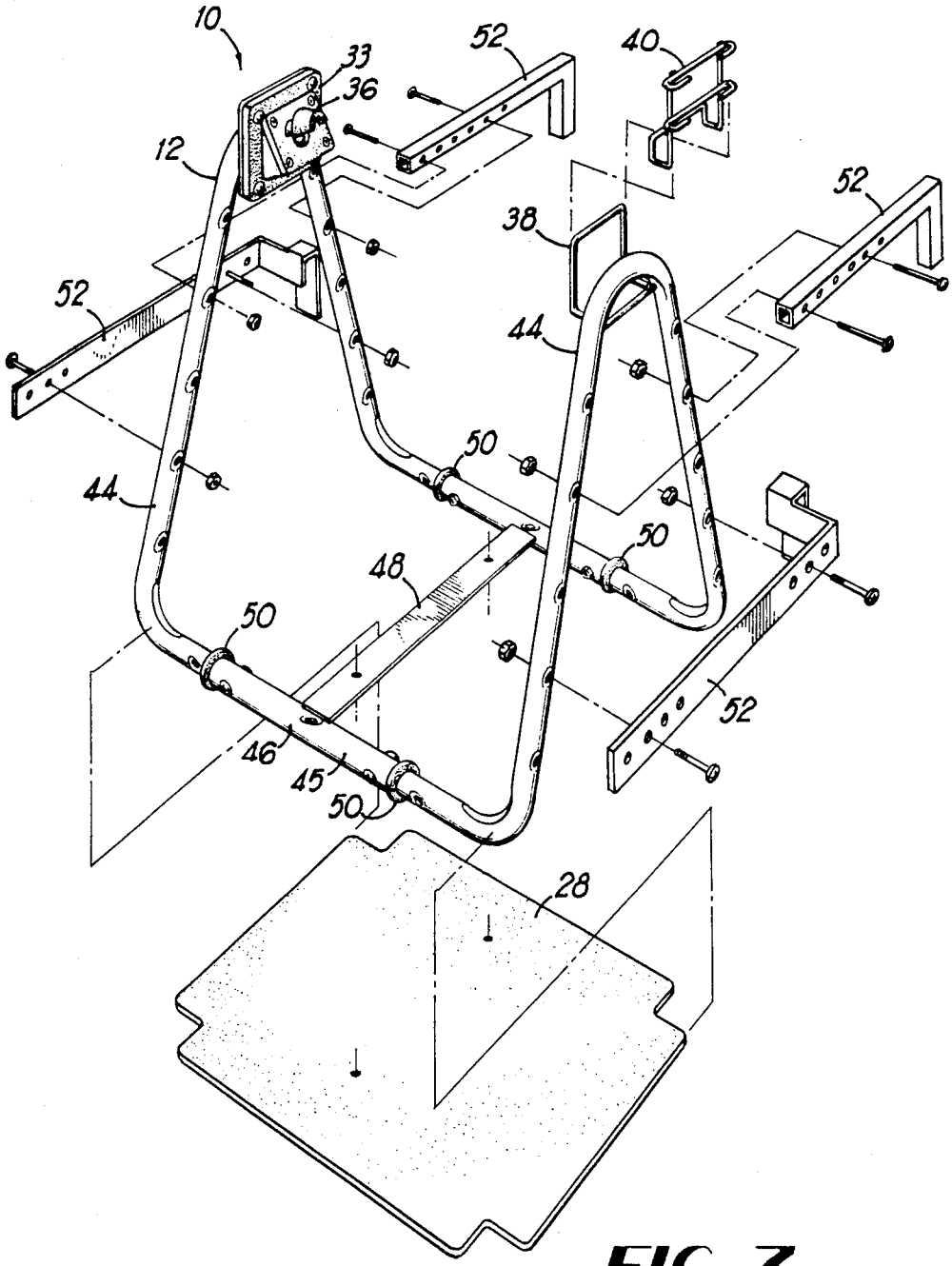
FIG. 7 is an exploded perspective view of a third embodiment of a dispenser according to the present invention.
Figure 8:
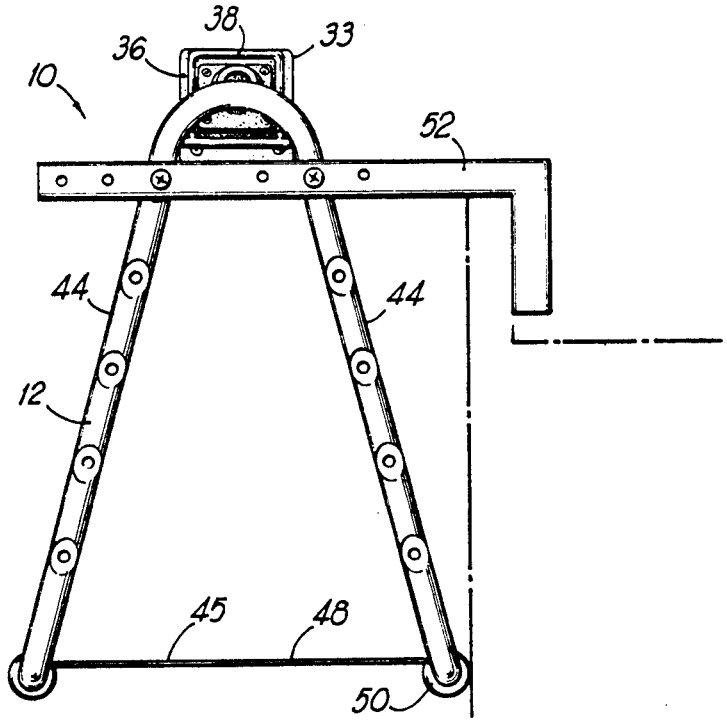
FIG. 8 is a side elevational view of the dispenser of FIG. 7 showing a first form of bracket for attaching the dispenser to a counter.
Figure 9:
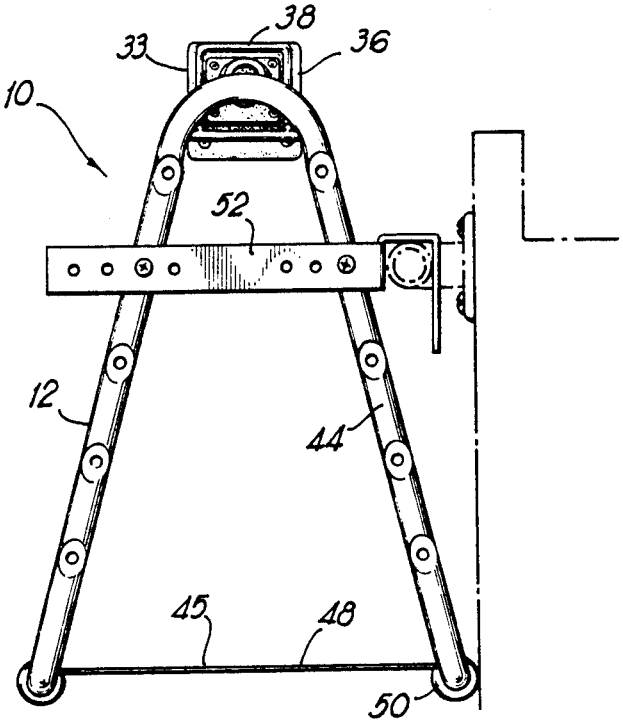
FIG. 9 is a side elevational view of the dispenser of FIG. 7 showing a second form of bracket for attaching the dispenser to a counter.

FIGS. 7–9 illustrate a third embodiment of a dispenser 10" according to the present invention which may be adjusted to accommodate a variety of sizes and shapes of flexible bags. Frame 12 of the embodiment of FIGS. 7–9 is formed of tubular material. Two upright or side portions 44 are generally "A" shaped and include horizontally oriented portions at their lower extremities which may be received by a base portion 45. In the embodiment shown in FIG. 7, base portion 45 is a pair of tubes 46 separated by a flange 48. Tubes 46 receive the horizontally oriented portions extending from uprights 44 in an adjustable manner. They may be bolted together adjustably, as shown in FIG. 7, or otherwise adjustably connected. Feet 50 of this embodiment may comprise elastic, polymeric or similar rings placed about tubes 46 or portions of upright 44. Uprights 44 support holder means 33, such as spool 34 and receiver 36 in an adjustable fashion as described above in connection with the embodiments shown in FIGS. 1–4 and 5 and 6. Similarly, suspending member 38 may accommodate an extender or extenders 40 for various sizes and shapes of bags.

The frame of dispenser 10" of FIGS. 7–9 may be adjusted in width to accommodate various sizes and shapes of bags in addition to being adjusted to support the bags 22 at various heights. The dispensers 10' of FIGS. 1–6 may also have cooperating tube sections or be otherwise configured to be adjustable in width. Thus, a taller bag 22 may be accommodated by adjusting base portion 45 and uprights 44 to a greater width and raising the height at which receiver 36 is mounted to an upright as well as omitting any extender from suspending means 38 or placing an extender about suspending member 38 that raises the level at which the bag 22 handle is held.

Dispenser 10" of FIGS. 7–9 may be mounted on adjacent surfaces by using brackets 52 or other appropriate means. A first form of bracket and 52' for extending over the lip of an adjacent surface is L-shaped and bolted at a desired height to an upright 44. A corresponding bracket 52' is bolted to the other upright. Brackets 52' may be formed of square tubing as shown; alternatively, they may be formed of wire to allow them to be connected or bolted to uprights 44 after being slid to their appropriate positions. Dispenser 10" is then moved to allow brackets 52' to engage the lip or other surface being captured. The bottom of dispenser 10" may be cushioned against the adjacent vertical wall by feet 50..

An alternative form of bracket may be used for engaging the horizontal bars which are typically located at the ends of check-out counters in grocery stores. Such a bracket, as shown in the relief in FIG. 7, is formed of flat material and has a downwardly protruding tongue for insertion between the horizontal rod and the counter. Such a bracket may be bolted to uprights 30 adjustably as mentioned above in connection with the L-shaped brackets.

The foregoing is provided for purposes of explanation and illustration. It will be apparent to one skilled in the relevant art that modifications and changes may be made to the invention as thus described without departing from its scope and spirit.

I claim:

1. An adjustable dispenser for bags, comprising:

(a) a base portion comprising two substantially parallel tubes connected to the ends of an elongated flange, each tube having a plurality of fastener openings;

(b) two generally "A" shaped upright portions formed of tubing, the lower extremity of each leg of each upright portion including a connection portion oriented generally orthogonally to the plane of the "A", each connection portion including a plurality of fastener openings and each connection portion slidably received by one of the parallel tubes of the base portion;

(c) a plurality of fasteners, each of which fasteners penetrates at least one fastener opening in the base portion and an upright portion;

(d) a pair of brackets, each of which is adjustably connected to one of the uprights for capturing an adjacent mounting surface and supporting the dispenser;

(e) a flange attached to the vertex of one of the upright portions, which flange contains a plurality of mounting openings;

(f) a receiver for supporting a bag holder, which receiver contains a plurality of mounting openings and is connected to the flange by at least one fastener which penetrates a mounting opening in the flange and the receiver;

(g) a suspending loop connected to the other portion for capturing an opening in a bag in order to hold the bag open while it is being filled; and (h) a baseboard located adjacent to the base portion.

2. An adjustable dispenser according to claim 1 further comprising an extender connected to the suspending loop in order to change the height at which bag openings are captured.

3. An adjustable dispenser according to claim 1 wherein the bag holder comprises a spool containing a plurality of plastic bags, which spool is mounted to the receiver.

4. An adjustable dispenser for bags, comprising:

(a) a back portion comprising a plurality of uprights attached to a plurality of rungs, each end of at least two of the rungs bent to form a loop;

(b) a first and a second side portion, each side portion comprising a loop of wire forming an upper, lower, forward and rear member and each side portion rotatably connected to the back portion by the rear member being rotatably captured in a plurality of the loops formed in the rungs of the back portion;

(c) a flange attached to the vertex of the upper and forward members of the first side portion, which flange contains a plurality of mounting openings;

(d) a receiver for supporting a bag holder, which receiver contains a plurality of mounting openings and is connected to the flange by at least one fastener which penetrates a mounting opening in the flange and the receiver;

(e) a suspending member formed in the upper member of the second side portion for capturing a hole in a bag positioned in the dispenser; and (f) a mounting bracket comprising a plurality of upright generally "C" shaped hooks and a bracket frame attached to the hooks, each of which hooks comprises a lower hook portion and an upper hook portion which is longer than the lower hook portion, the upper hook portions capturing one of the rungs of the back portion and the lower hook portions capturing another of the rungs of the back portion.

5. An adjustable bag dispenser according to claim 4 further comprising a loop of wire connected to one of the upright members of the back portion for retaining bags in place.

6. An adjustable bag dispenser according to claim 4 further comprising an extender connected to the suspending member, which extender comprises a plurality of generally "C" shaped hooks for capturing the suspending member, which hooks are connected to a wire loop forming a generally "J" shaped lip for capturing a hole in a bag positioned in the dispenser.

7. An adjustable bag dispenser according to claim 4 further comprising a flange attached to the bottom member of each side portion, and a baseboard attached to the flanges.

8. An adjustable bag dispenser according to claim 7 further comprising a plurality of feet connected to each flange.

9. An adjustable bag dispenser according to claim 4 comprising an indented portion formed in the forward member of the second side portion.

10. An adjustable dispenser for bags, comprising:

(a) a generally "W" shaped frame comprising:

(1) a back portion comprising a plurality of lateral members connected by a plurality of uprights; and (2) a first, second and third side portion extending generally orthogonally from the back portion, each side portion comprising a loop of wire forming an upper, forward and lower member, the first and third side portions extending from the lateral ends of the back portion;

(b) a flange attached to the vertex of the upper and forward member of each of the first and second side portions, each of which flanges contains a plurality of mounting openings;

(c) two receivers for supporting a bag holder, each of which receivers contains a plurality of mounting openings and is connected to one of the flanges by at least one fastener which penetrates a mounting opening in the flange and the receiver;

(d) two suspending members, each formed in the upper member of the second and third side portions respectively for capturing a hole in a bag positioned in the dispenser; and (e) at least one mounting bracket comprising a plurality of upright generally "C" shaped hooks and a bracket frame attached to the hooks, each of which hooks comprises a lower hook portion and an upper hook portion which is longer than the lower hook portion, the upper hook portions capturing one of the lateral members of the back portion of the dispenser frame and the lower hook portions capturing another of the lateral members.

11. An adjustable bag dispenser according to claim 10 further comprising two loops of wire for retaining bags in place, each loop connected to two of the lateral members of the back portion of the frame between two side portions.

12. An adjustable bag dispenser according to claim 10 further comprising two extenders, each connected to a suspending member, and each of which comprises a plurality of generally "C" shaped hooks for capturing a suspending member, each of which hooks is connected to a wire loop forming a generally "J" shaped lip for capturing a hole in a bag positioned in the dispenser.

* * * * *